US006895873B1

(12) United States Patent
Searle

(10) Patent No.: US 6,895,873 B1
(45) Date of Patent: May 24, 2005

(54) SECURITY CABINET, COMBINED SECURITY UNIT AND PICK UNIT, AND ATM INCLUDING SUCH AN ARRANGEMENT

(75) Inventor: Andrew Searle, Lydford (GB)

(73) Assignee: Spinnaker International Limited, Plymouth (GB)

( * ) Notice: Subject to any disclaimer, the term of this patent is extended or adjusted under 35 U.S.C. 154(b) by 20 days.

(21) Appl. No.: 10/030,561

(22) PCT Filed: Jul. 11, 2000

(86) PCT No.: PCT/GB00/02682

§ 371 (c)(1),
(2), (4) Date: Apr. 25, 2002

(87) PCT Pub. No.: WO01/06464

PCT Pub. Date: Jan. 25, 2001

(30) Foreign Application Priority Data

Jul. 19, 1999 (GB) ..... 9916893

(51) Int. Cl.[7] ..... E05G 1/00

(52) U.S. Cl. ..... 109/25; 109/29

(58) Field of Search ..... 109/25, 29–32, 109/56, 38–44

(56) References Cited

U.S. PATENT DOCUMENTS

| | | | | |
|---|---|---|---|---|
| 4,363,279 | A * | 12/1982 | Johansson | 109/29 |
| 4,884,514 | A | 12/1989 | Shockey et al. | |
| 5,598,793 | A * | 2/1997 | Lopez, Jr. | 109/25 |
| 5,615,625 | A * | 4/1997 | Cassidy et al. | 109/45 |
| 5,787,819 | A * | 8/1998 | Fumanelli | 109/38 |
| 6,453,828 | B1 * | 9/2002 | Fumanelli | 109/25 |
| 6,497,186 | B1 * | 12/2002 | Lundblad | 109/25 |
| 6,513,444 | B2 * | 2/2003 | Walker | 109/25 |
| 6,553,922 | B1 * | 4/2003 | Lundblad et al. | 109/25 |
| 6,564,726 | B1 * | 5/2003 | Lindskog | 109/25 |
| 6,712,011 | B2 * | 3/2004 | Fumanelli | 109/20 |

FOREIGN PATENT DOCUMENTS

| | | |
|---|---|---|
| EP | 0 692 599 A1 | 1/1996 |
| EP | 0 848 130 A2 | 6/1998 |
| GB | 885245 | 12/1961 |
| GB | 1108643 | 4/1968 |
| GB | 2269205 | 2/1994 |
| WO | WO 93/02435 | 2/1993 |

* cited by examiner

*Primary Examiner*—John B. Walsh
(74) *Attorney, Agent, or Firm*—Reising, Ethington, Barnes, Kisselle, P.C.

(57) ABSTRACT

A security cabinet (2) is provided in which security boxes are protected by virtue of being connected to a spoiling system. A data processor monitors sensors around the cabinet to determine when an attack is being made.

17 Claims, 4 Drawing Sheets

SECURITY CABINET, COMBINED SECURITY UNIT AND PICK UNIT, AND ATM INCLUDING SUCH AN ARRANGEMENT

CROSS-REFERENCES TO RELATED APPLICATIONS

This is a 371 of International Application Number PCT/GB00/02682 having an international filing date of Jul. 11, 2000.

STATEMENT REGARDING FEDERALLY SPONSORED RESEARCH OR DEVELOPMENT

Not Applicable

BACKGROUND OF THE INVENTION

1. Field of the Invention

The present invention relates to a security cabinet, and in particular, though not exclusively, to a cabinet for protecting cash cassettes for use with automatic teller machines (ATMs). The invention also relates to a combined security cabinet and ATM pick unit and to an ATM machine including such a combined unit.

2. Description of the Related Art Including Information Disclosed Under 37 CFR 1.97 and 1.98.

Automatic teller machines are now common. Each machine carries a number of removable cassettes in which money is stored. Other valuable items, such as stamps or tickets may be stored in similar machines. It is necessary, from time to time, to replenish the cassettes in an ATM. This is normally done at fixed intervals based on the expected usage of the machine. Each cassette may contain a considerable amount of money, and consequently theft of one or more cassettes represents a relatively easy way of obtaining a significant amount of money for a criminal. Furthermore, when a new cassette is stored in a new machine, a "empty" cassette is removed from the machine. However, since replenishment may be done at predetermined intervals rather than when the cassettes are low or empty, the "empty" cassettes may in fact contain a considerable amount of money.

WO 93 02435 A discloses apparatus for contaminating valuables held in a plurality of containers removably mounted within a housing by delivering contamination material into each container from a reservoir, the reservoir and delivery system being housed outside each container. Each container is separately removable from the apparatus for refilling.

EP-A-0 692599 discloses a system for the secure transportation of articles comprising first and second docking stations at different locations and a secure container that mates with the docking stations. The container has a number of lockable doors into which bank notes are fed by a feeder mechanism at the first docking station.

BRIEF SUMMARY OF THE INVENTION

According to a first aspect of the present invention, there is provided a mobile security cabinet for engagement with an automatic dispensing machine, characterised by a plurality of reception regions for receiving and engaging with containers for said dispensing machine, each container arranged to hold money or other valuables and including delivery means for delivering a spoiling agent to spoil the contents of the container, the security cabinet further comprising at least one sensor for detecting an attempt to open the cabinet or an attempt to remove a container, and a controller responsive to the at least one sensor for initiating spoiling of the contents of the containers via the delivery means, the cabinet further including a pick unit for the dispensing machine such that the mobile security cabinet can be engaged with a dispensing machine without exposing said containers.

It is thus possible to provide a security cabinet which can give simultaneous protection to a plurality of security containers and which can spoil the contents of the containers in the event of an attack Preferably the security cabinet has for example, castors or wheels, such that the entire unit can be delivered to the dispensing machine.

Preferably the security cabinet can be docked with an dispensing machine thereby delivering cash to an dispensing machine without the need to open the cabinet at or adjacent the dispensing machine.

Preferably the cabinet includes a locking system for locking each security container within its reception region. Advantageously one or more position detectors are provided to determine when the or each security container is correctly engaged with the security cabinet. The tolerances between the security cabinet and the security containers may, deliberately, be tight and consequently even a small amount of displacement from the normal engagement position can be detected. Such displacement may result from a deliberate attempt to tamper with the security system.

Preferably the cabinet is provided with a penetration detection arrangement which, advantageously, may be formed as part of the cover of the cabinet. The cover may, for example, have conductors embedded therein such that an attempt to penetrate the cover will damage the conductors embedded therein and consequently can be detected.

Advantageously the door of the cabinet, or other openable closure is also provided with penetration detection means. Furthermore, the door or closure may engage with a lock which is controlled by the controller within the cabinet.

Preferably the cabinet includes data exchange devices, such as infrared or radio frequency links, to communicate with other security systems. Examples of such systems include a security system at a cash cassette replenishment centre, a security system of a delivery vehicle used to deliver the cash cassettes from the replenishment centre to users, such as banks, and security systems at the delivery point. Such systems may include bank security systems which may control operation of the bank doors and also the dispensing machine itself which may not release its own door locks or disable some of its own security features until such time as it has authenticated that an authorised delivery is being made to the machine. The cabinet may also be used to deliver encryption keys and other data to the dispensing machine in a secure manner.

Preferably the dispensing machine is an automatic teller machine, ATM.

Preferably the valuables contained within each security container are paper or plastics valuables where the valuables can be spoiled by contact with an ink or other suitable spoiling agent.

Preferably the security cabinet includes position and/or motion determining means for providing a measurement of position and/or motion to the control means. In this way, the control means can identify the position of the cabinet, or the occurrence of motion of the cabinet and to use this data to determine whether an attempt is being made to physically remove the cabinet from its expected position or to move it from an expected delivery route, and thereby provide an indication that a theft is in progress. The cabinet may include a global position satellite (GPS) receiver and/or accelerometers and/or gyroscopes. Furthermore, the security cabinet may obtain positional information from a delivery vehicle whilst the cabinet is in or adjacent the vehicle.

Advantageously the connectors forming the delivery system for the spoiling means between the security cabinet and the or each security container include co-operating male and female connectors which are provided with path clearing means or sweeping means in order to push debris or other foreign matter away from the fluid delivery path as the connectors are brought into engagement with one another. Advantageously, a sensor is provided to give an indication that debris was obstructing the path, or that the delivery path is formed to an acceptable standard. This provides security against deliberate tampering.

Preferably the or each security container is a cash cassette for an ATM.

According to a second aspect of the present invention, there is provided a replaceable cash store for an automatic teller machine, comprising a portable container defining a plurality of cash storage regions therein, a spoiling arrangement for delivering a spoiling agent to the cash storage regions, at least one sensor for detecting an attack on the cash store and a controller for initiating operation of the spoiling arrangement, characterised by said cash store being dockable with an automatic teller machine such that cash can be delivered to the Automatic teller machine without opening the cash store.

Preferably, further sensors are provided for determining when the cash store is properly engaged with the ATM.

Advantageously, the ATM pick unit is integrated into the cash store. This has a particular advantage, since the ATM pick unit comprises many moving parts and these can be frequently returned to a service department thereby allowing maintenance to be carried out on a regular basis whilst not impacting on the operation of the ATM itself.

The cash store may act as the primary source of protection within the ATM, and consequently the ATM can be made smaller and lighter and at less cost. It is further possible to provide physically smaller portable ATMs for use at temporary locations whilst the cash is maintained within a security cabinet according to either of the first or second aspects of the present invention.

According to a third aspect of the present invention, there is provided a mobile security cabinet for engagement with an automatic dispensing machine, characterised by comprising a plurality of reception regions for receiving and engaging with security boxes, each security box including delivery means for delivering a spoiling agent from at least one reservoir within the security cabinet so as to spoil the contents of the security box, the security cabinet further comprising at least one sensor for detecting an attempt to open the cabinet and a controller responsive to the at least one sensor for initiating spoiling of the contents of the boxes via the delivery means, each security box having a connector for engaging with a cooperating connector of the cabinet when the security box is in a reception region, the co-operating connectors including means for displacing foreign matter out of the fluid delivery path between the connectors as the connectors move into engagement, the mobile security cabinet being engagable with an automatic dispensing machine without exposing said security boxes.

It is thus possible to provide a security cabinet having a reception region for receiving and engaging with security boxes, each security box including delivery means for delivering a spoiling agent to spoil the contents of the security box, and wherein the cabinet includes at least one sensor for detecting an attempt to open the cabinet or an attempt remove a security box, and a controller responsive to the at least one sensor for initiating spoiling on the contents of the boxes via the delivery means.

BRIEF DESCRIPTION OF THE SEVERAL VIEWS OF THE DRAWINGS

The present invention will further be described by way of example, with reference to the accompanying drawings, in which.

DETAILED DESCRIPTION OF INVENTION EMBODIMENT(S)

Figure 1:
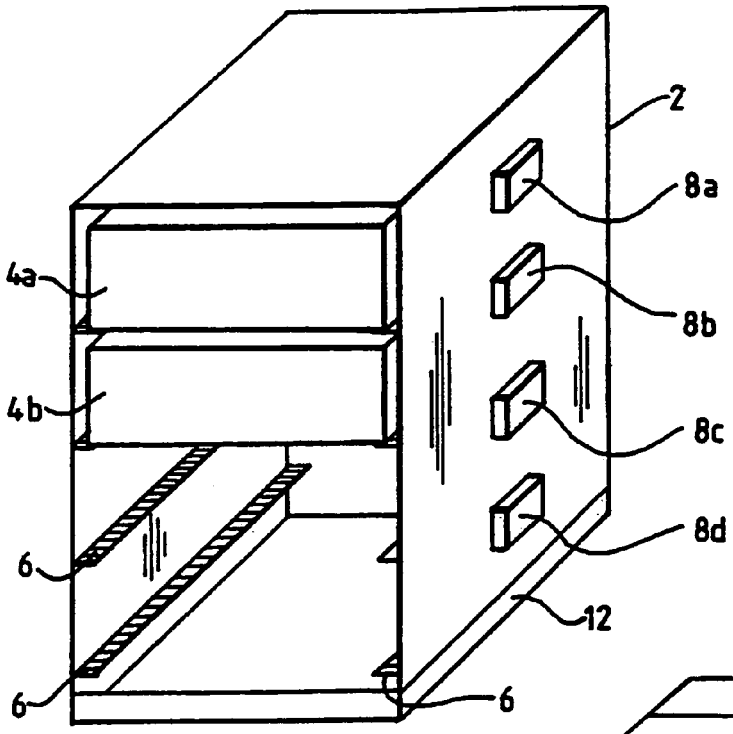
FIG. 1 is a perspective view of a security cabinet constituting a first embodiment of the present invention.

FIG. 1 is a cutaway perspective view of a security cabinet constituting an embodiment of the present invention. The external cover of the cabinet, and the door, have been omitted for clarity. The cabinet 2 serves to define a protected storage rack for a plurality of cash cassettes 4*a*, 4*b*. In the embodiment shown, the cabinet 2 can enclose up to four cassettes 4*a*–4*d*. Cassette guides 6 are formed on opposing sides of the cabinet and effectively serve to partition the cabinet into four reception regions for the respective cash cassettes. Each cash cassette, when in its engaged position, is in fluid flow communication with a respective reservoir 8*a* to 8*d* of a spoiling agent. The spoiling agent may, for example, be ink which is arranged to be expelled from the reservoir under the action of compressed gas. A suitable spoiling system is disclosed in the applicant's pending application PCT/GB98/03882 having an international filing date of Dec. 22, 1998, to which reference should be made for further details. A shared reservoir of spoiling agent may be provided.

The position of each cash cassette 4*a* is monitored within its reception region in order to confirm that the cash cassette has attained its proper position, and consequently to infer that a fluid flow path has been established from the spoiling agent to the interior of the cash cassette. Advantageously the connection between the cash cassettes 4*a* to 4*d* and the spoiling means 8*a* to 8*d* comprise a connection arrangement as described in the applicant's above mentioned international application. The ink delivery system comprises co-operating male and female parts indicated generally as 100 and 102. The female part 102 is, in the embodiment illustrated in FIG. 5, attached to the cash cassette. Advantageously, but not necessarily, the female part 102 is in the spring loaded attachment such that it can move between the positions generally indicated as 103 and 104 which show the same part 102 in different positions. As shown, a casing 110 has a tapered inlet 112 formed therein. The inlet 112 may have a generally conical profile which then merges with a cylindrical bore 114. The bore 114 is a blind bore, but has at least one ink delivery outlet 116 formed in a side wall thereof adjacent, but not at, the end of the bore 114. Only one delivery outlet is illustrated for simplicity, but a plurality of delivery outlets may be provided. They may be longitudinally or radially disposed with respect to each other. Furthermore, the outlets may be elongated to allow correct operation to be maintained even if some longitudinal movement/misalignment occurs. The ink delivery outlet is in fluid flow communication with a, preferably flexible pipe 118 which extends into the interior of the cash cassette. The casing 110 may also incorporate a guide pin or other suitable locking element which provides a point of attachment to a locking device, for example in the form of an arm, carried on the male part 100. The use of a plurality of delivery outlets enables the ink to be delivered more rapidly.

Figure 5:
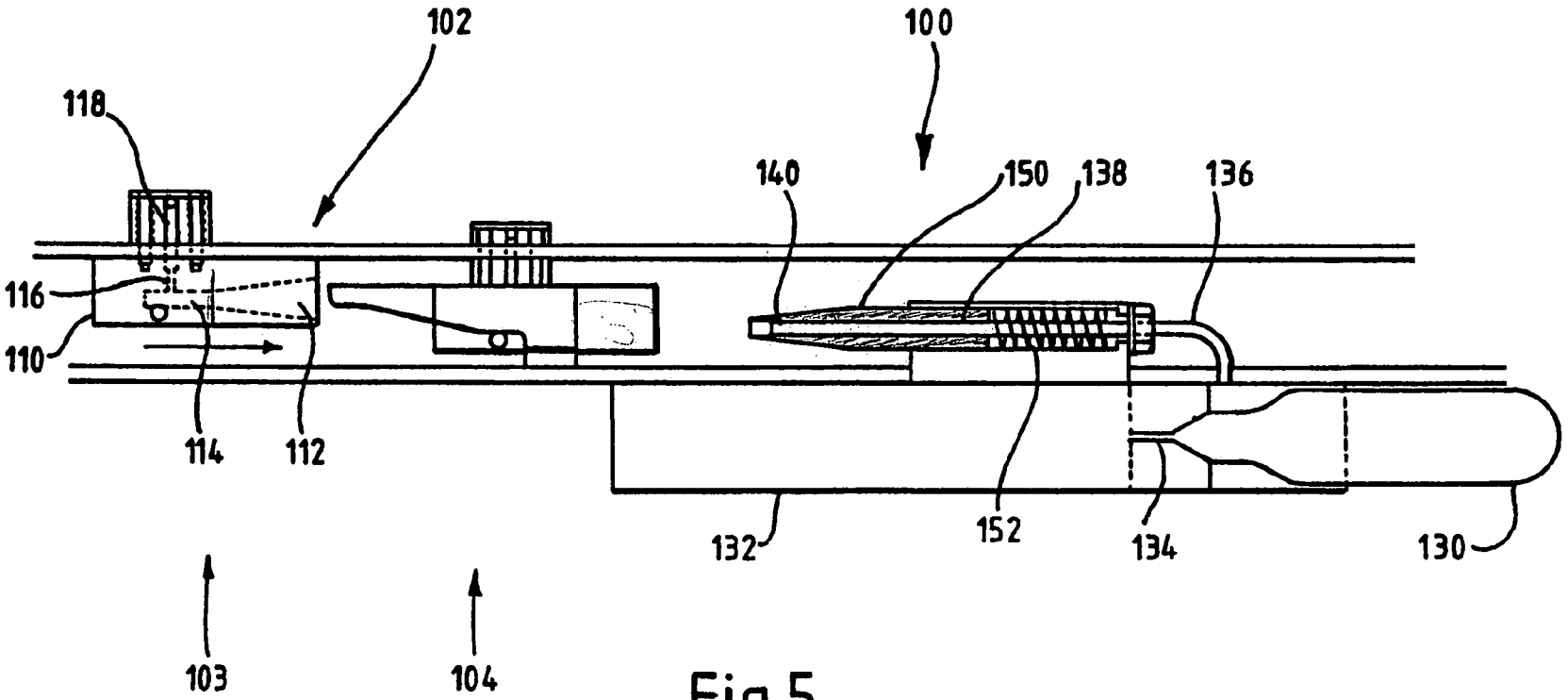
FIG. 5 shows the arrangement for connecting the ink delivery paths.

The ink injection unit as housed in elements 8*a* to 8*d* comprises a gas canister 130 coupled to an ink reservoir 132 via a throttling orifice 134. The gas canister is opened via a pyrotechnic device (not shown) which is actuated to rupture a seal of the canister 130. The interior of the ink reservoir 132 is in fluid flow communication with a delivery passage 136 which forms a central delivery pipe 138 of the male member 100. The delivery pipe 138 opens at a sideways facing aperture 140 which, in use, aligns with the ink outlet passage 116 when the male and female elements are correctly coupled together. A sleeve 150 extends around the delivery pipe 138. The sleeve 150 is slideable with respect to the delivery pipe between a first position as illustrated in FIG. 5 in which the sleeve extends over the outlet 140 and a second position in which the sleeve slides to the right as shown in FIG. 5 in order to expose the delivery outlet 140. The sleeve is urged to the first position by compression spring 152.

In use, as a cash cassette is loaded into the security cabinet, the male and female parts move towards each other and the sleeve 150 engages with the conical recess 112 and is pushed against the urging of the compression spring 152 to uncover the aperture 140. This relative motion also ensures that any debris in the aperture 112 is pushed passed the outlet pipe 116 thereby ensuring that debris cannot be deliberately introduced into the aperture 112 in order to defeat the security system. A position sensor (not shown) monitors the relative motion of the sleeve 150 with respect to the delivery pipe to ensure that it reaches the correct position. This position is monitored by the controller as an indication of when the ink delivery path has been properly established.

The cabinet 2 also includes a compartment 12 which houses a data processor and other associated electronics.

Figure 2:
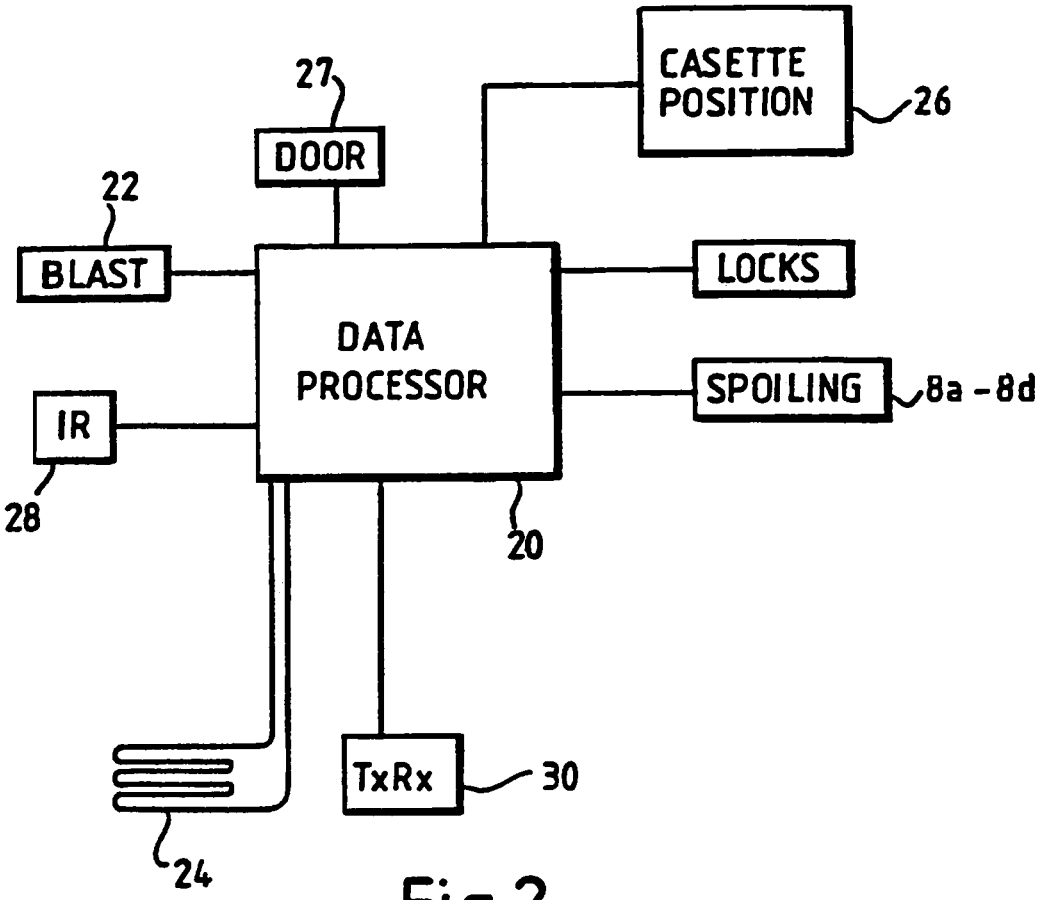
FIG. 2 is a block diagram schematically illustrating the internal relationship between the cabinet's data processor and ancillary systems.

FIG. 2 schematically illustrates the interconnection between various systems within the security cabinet. A data processor 20 is arranged to receive inputs from a blast detector 22, a penetration detector 24 (in the form of an elongate conductor), one or more cassette position sensors 26, door switches 27, a bi-directional infrared link 28 and a bi-directional radio link 30. The data processor is also arranged to control locks within the security cabinet, and more specifically locks for engaging the cash cassettes 4*a* to 4*d* and also a door lock which operates on the door of the security cabinet. The data processor is also arranged to initiate actuation of the spoiling systems 8*a* to 8*d*.

The data processor is arranged such that it receives information via the infrared or radio links concerning the contents of the cash cassettes when the cabinet is at a replenishment station. The data processor is also given details of the delivery points that the delivery vehicle will be travelling to, optionally the route that will be taken and the expected delivery times, and bank and automatic teller security codes such that the data processor can negotiate with other security systems in order that both systems can confirm the authenticity of the other.

Before leaving the replenishment station, the data processor examines the outputs of the cassette position sensors, and once it has determined that the cassettes are properly loaded and that the cabinet door is shut, it operates the locks to secure the contents of the cabinet.

During transport to the various delivery points, the data processor may receive positional information, either from a GPS system incorporated within the cabinet, or from the vehicle's positioning system. Once the vehicle reaches the predetermined delivery point, the data processor 20 may release the door lock on the cabinet and, after negotiating with a further security system, may also release one or more of the cash cassettes for delivery to an ATM. However, the cabinet may be delivered directly to the ATM, and in such circumstances, the data processor does not release any of the cabinet security features but places itself in a "transport" mode where it monitors the distance travelled, or travel time, or nature of the travel between itself and its expected delivery point in order to determine whether it has been hijacked in transit between the delivery van and its destination.

Figure 6:
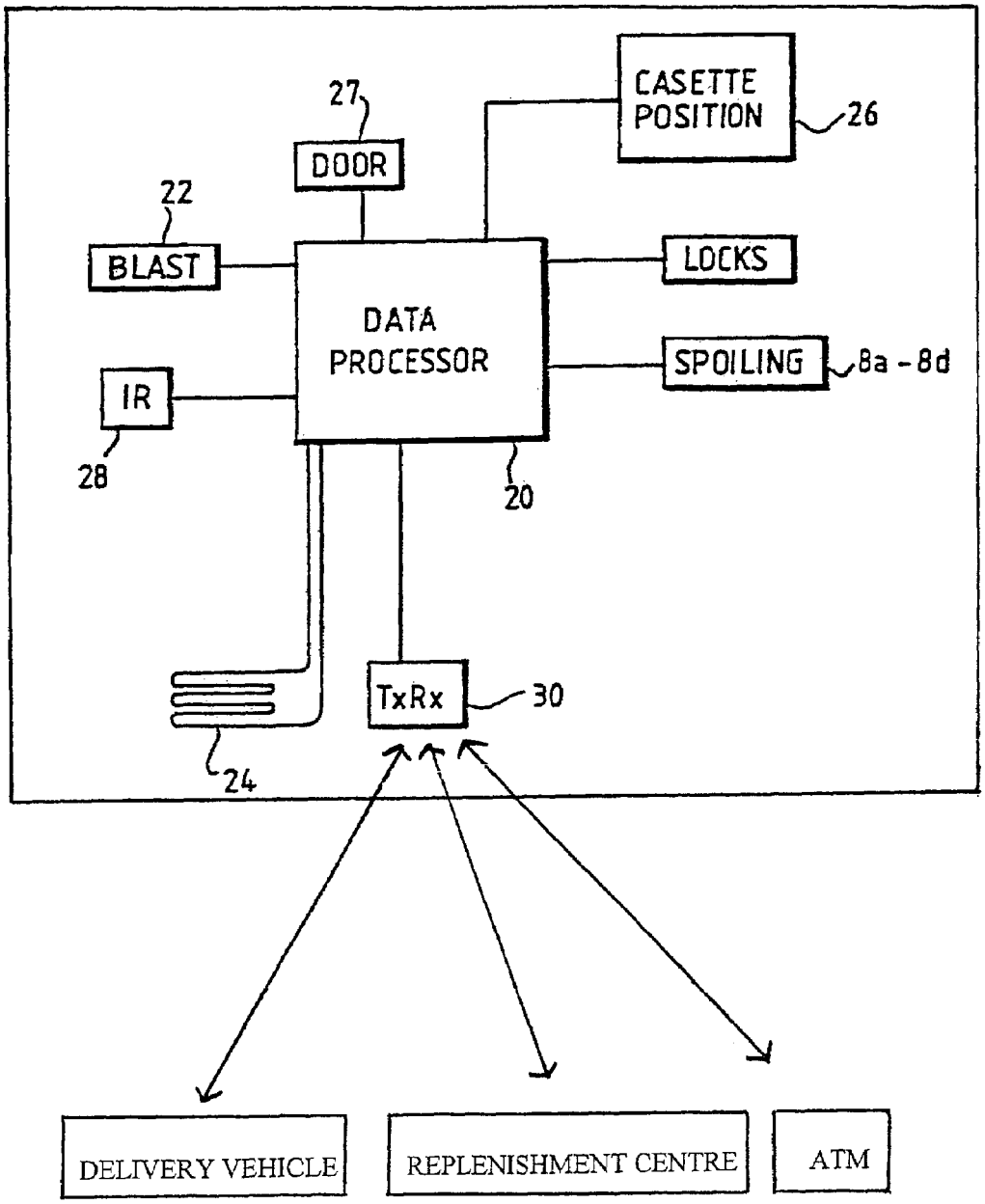
FIG. 6 schematically illustrates the communication interrelationship between a security cabinet constituting an embodiment of the present invention and the security system of a delivery vehicle, a replenishment centre and an automatic teller machine.

FIG. 6 schematically illustrates that the data processor can establish bi-directional communications using the transmitter receiver 30 with security systems located within the delivery vehicle and a replenishment centre, as well as negotiating with the security system included within the ATM.

Figure 3:
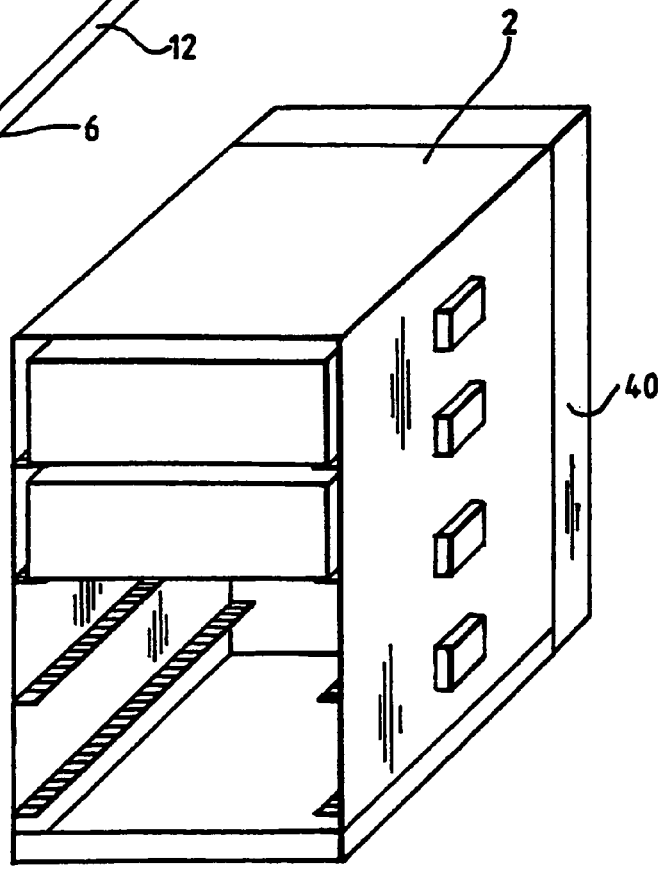
FIG. 3 is a perspective view of a combined security cabinet and ATM pick unit.

As shown in FIG. 3, an ATM pick unit 40 may be integrated with a security cabinet 2. In such an arrangement, the combined security cabinet and pick unit may be loaded into the ATM as a single module in exchange for the cash cassette and pick unit already in place in the ATM. Under such circumstances, the data processor does not need to release its door lock and maintains responsibility for security of the cash cassette even when the combined unit has been installed within the ATM. The pick unit is a known component and its internal structure need not be described here. However, when in position the pick-unit does need to be in electrical and/or mechanical connection with the ATM.

Figure 4:
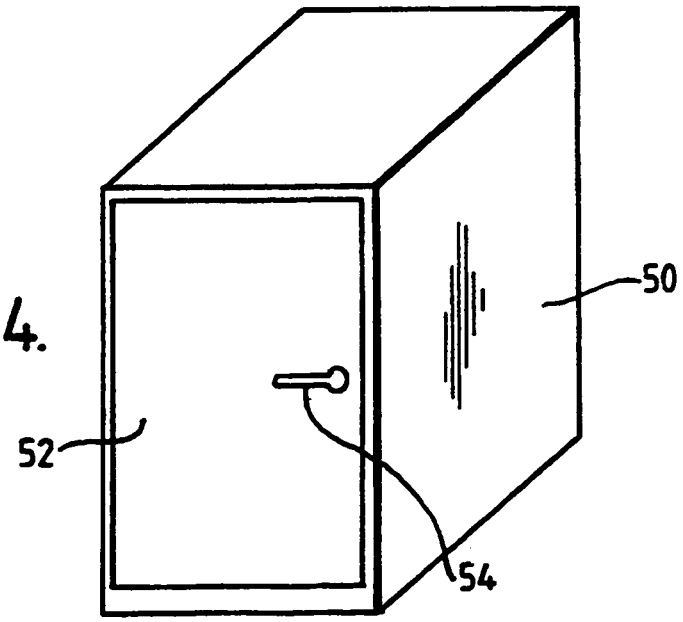
FIG. 4 is a perspective view of the cabinet of FIG. 1 with its door and cover in position.

FIG. 4 illustrates a perspective view of the cash cassette shown in FIG. 1 with its anti-penetration cover and door 52 in place. It is apparent that the cabinet has an anti-penetration covering on all sides of the cabinet and that none of its internal components are exposed. The door 52 is provided with a handle 54 in order to aid opening of the door by authorised operators.

It is thus possible to provide a security cabinet, and more specifically, a cabinet for cash cassettes of an automatic teller machine which holds the cassettes in a protected environment such that, in the event of an attack, a spoiling system can be opted in order to spoil the content of the cassette. Furthermore, the unit can be provided with an ATM pick unit in order to form a combined module which can simply be slotted into and out of ATMs in order to accomplish replenishment of the ATMs without exposing the cassettes to attack. It will be appreciated that the security boxes need not be ATM cash cassette boxes and that the cabinet can be used to protect valuables during delivery or may act as a "safe" in venues such as hotels, guest houses and the like. Dummy cash cassettes may be provided, where the cash cassette is externally physically similar to an ATM cash cassette, such that a single cabinet can be used for ATM deliveries and non-ATM deliveries.

What is claimed is:

1. A mobile security cabinet for engagement with an automatic dispensing machine, the mobile security cabinet comprising a plurality of reception regions for receiving and engaging with containers, each container including a delivery unit for delivering a spoiling agent to spoil the contents of the container, the security cabinet further comprising at least one sensor for detecting an attempt to open the cabinet or an attempt to remove a container, and a controller responsive to the at least one sensor for initiating spoiling of the contents of the containers via the delivery unit, the cabinet further including a pick unit that engages the mobile security cabinet with an automatic dispensing machine while said containers remain enclosed within the mobile security cabinet, the mobile security cabinet is received into engagement with an automatic dispensing machine, and the contents of the containers made available to the automatic dispensing machine via the pick unit.

2. A security cabinet as claimed in claim 1, wherein the spoiling agent is held in at least one reservoir within the security cabinet.

3. A security cabinet as claimed in claim 1, wherein the spoiling agent is held in at least one reservoir within the containers.

4. A security cabinet as claimed claim 1, wherein a locking arrangement is provided to hold each container within its reception region.

5. A security cabinet as claimed claim 1, wherein at least one position detector is provided to determine when a container is correctly engaged with the cabinet.

6. A security cabinet as claimed in claim 1, wherein the cabinet has a penetration detecting covering.

7. A security cabinet as claimed in claim 6, wherein the penetration detecting covering covers substantially the entire surface of the cabinet.

8. A security cabinet as claimed in claim 6 wherein the cabinet has an openable closure, which openable closure is acted upon by a lock.

9. A security cabinet as claimed in claim 8, wherein the lock is controlled by the controller.

10. A security cabinet as claimed in claim 2, wherein each security container includes one of a male and female connector for engaging with a co-operating one of a female and male connector of the security cabinet when the container is at its reception region.

11. A security cabinet as claimed in claim 10, wherein the co-operating connectors include a sweeping means for displacing foreign matter out of the fluid delivery path between the connectors as the connectors move into engagement with one another.

12. A security cabinet as claimed in claim 1, further including position and/or motion determining means for providing a measurement of position and/or motion to the controller such that the controller can detect unauthorised movement of the cabinet and initiate spoiling of the contents of the cassette.

13. A security cabinet as claimed in claim 1, wherein the cabinet further includes at least one data exchange device for exchanging data with other security systems, selected from a list comprising:

security systems at a replenishment centre;

security system of a delivery vehicle; and security systems of an automatic teller machine.

14. A security cabinet as claimed in claim 13, in which the cabinet is arranged to exchange identity information to the ATM and/or encryption/decryption keys.

15. An ATM in combination with a security cabinet as claimed in claim 1.

16. A replaceable cash store for an automatic teller machine, comprising a portable container defining a plurality of reception regions for receiving and engaging with containers, a spoiling arrangement for delivering a spoiling agent to the containers, at least one sensor for detecting an attack on the cash store and a controller for initiating operation of the spoiling arrangement, in which said cash store is dockable with an automatic teller machine such that cash can be delivered from the container to the Automatic teller machine without opening the cash store.

17. A mobile security cabinet for engagement with an automatic dispensing machine, comprising a plurality of reception regions for receiving and engaging with security boxes, each security box including delivery means for delivering a spoiling agent from at least one reservoir within the security cabinet so as to spoil the contents of the security box, the security cabinet further comprising at least one sensor for detecting an attempt to open the cabinet and a controller responsive to the at least one sensor for initiating spoiling of the contents of the boxes via the delivery means, each security box having a connector for engaging with a co-operating connector of the security cabinet when the security box is in a reception region, the co-operating connectors including means for displacing foreign matter out of a fluid delivery path between the connectors as the connectors move into engagement, and wherein the mobile security cabinet is engageable with an automatic dispensing machine without exposing said security boxes.

* * * * *